US007443271B2

(12) United States Patent
Araki et al.

(10) Patent No.: US 7,443,271 B2
(45) Date of Patent: Oct. 28, 2008

(54) RING FILTER WIDEBAND BAND PASS FILTER USING THEREWITH

(75) Inventors: Kiyomichi Araki, Tokyo (JP); Hitoshi Ishida, Tokyo (JP); Takao Nakagawa, Tokyo (JP)

(73) Assignee: The Circle for the Promotion of Science and Engineering, Tokyo (JP)

( * ) Notice: Subject to any disclaimer, the term of this patent is extended or adjusted under 35 U.S.C. 154(b) by 245 days.

(21) Appl. No.: 10/558,058

(22) PCT Filed: Feb. 20, 2004

(86) PCT No.: PCT/JP2004/001963

§ 371 (c)(1),
(2), (4) Date: Nov. 21, 2005

(87) PCT Pub. No.: WO2004/105175

PCT Pub. Date: Feb. 12, 2004

(65) Prior Publication Data

US 2007/0063794 A1 Mar. 22, 2007

(30) Foreign Application Priority Data

May 22, 2003 (JP) ..... 2003-144297

(51) Int. Cl.
*H01P 1/203* (2006.01)

(52) U.S. Cl. ..... 333/204; 333/219

(58) Field of Classification Search ..... 333/204, 333/219

See application file for complete search history.

(56) References Cited

U.S. PATENT DOCUMENTS 5,479,142 A * 12/1995 Takahashi et al. ..... 333/204

FOREIGN PATENT DOCUMENTS

| | | |
|---|---|---|
| JP | 58-009002 | 6/1983 |
| JP | 62-160801 | 7/1987 |
| JP | 62-224948 | 10/1987 |
| JP | 05-315805 | 11/1993 |
| JP | 09-139612 | 5/1997 |
| JP | 2800323 B2 | 7/1997 |
| JP | 2000-209002 | 7/2000 |
| JP | 2000-252706 | 9/2000 |
| JP | 2001-102806 | 4/2001 |
| JP | 2002-026606 | 1/2002 |
| JP | 2002-158503 | 5/2002 |

* cited by examiner

*Primary Examiner*—Benny Lee
(74) *Attorney, Agent, or Firm*—Ladas & Parry LLP

(57) ABSTRACT

In order to provide a band pass filter for high wavelength which has a wideband, small insertion loss and flat passband and obtains steep attenuation, a plurality of ring filters, in which, an input terminal of a high-frequency signal is provided to an arbitrary point on a line in a microstripline ring resonator having the line with one wavelength at electrical length, an output terminal is provided to a point positioned at a half wavelength at electrical length from the input terminal, a open stub of ¼ wavelength at electrical length (or ½ wavelength short stub) is connected to a point positioned at ¼ wavelength at electrical length from the input terminal, are connected by cascade connection with attenuation pole frequencies being different.

9 Claims, 17 Drawing Sheets

$Z_1=50\Omega$, $Z_2=90\Omega$, $Z_3=22.14\Omega$ $Z_1=60\Omega$, $Z_2=90\Omega$, $Z_3=22.14\Omega$ $Z_1=65.79\Omega$, $Z_2=90\Omega$, $Z_3=22.14\Omega$ $Z_1=70\Omega$, $Z_2=90\Omega$, $Z_3=22.14\Omega$

RING FILTER WIDEBAND BAND PASS FILTER USING THEREWITH

TECHNICAL FIELD

The present invention relates to a ring filter and a wideband band pass filter using it, and more concretely, the invention relates to the ring filter in which one open stub or one short stub is provided to a ring resonator and which is constituted by a microstripline, and the wideband band pass filter using it.

BACKGROUND ART

In high-frequency circuit sections such as an RF stage in a transmitting circuit and a receiving circuit for mobile communication devices or the like including analog or digital mobile phones or wireless phones, for example, in the case where the same antenna is shared by the transmitting circuit and the receiving circuit, in order to remove unnecessary signal waves other than desired signal waves such as to separate a transmission frequency band and a reception frequency band or to attenuate a harmonic generated based on nonlinearity of an amplifier circuit, band pass filters are frequently used. Such band pass filters used for communication devices are mostly constituted by microstriplines or the like because filter circuits sections can be small or electrical characteristics as high-frequency circuits are satisfactory.

The band pass filters which are constituted by the microstriplines can be easily applied to MIC (Microwave Integrated Circuits) and MMIC (Monolithic Microwave Integrated Circuits), but band pass filters using conventional microstriplines are constituted by a plurality of ¼ wavelength (hereinafter, means electrical length) lines which are side-coupled.

In general, two representative characteristics are known as the characteristics of the band pass filters. One is a Chebyshev characteristic shown in FIG. 8A, and a ripple appears in passband, but cut-off characteristic (steepness) is satisfactory. The other one is a Butterworth characteristic shown in FIG. 8B, and since the passband is flat and a ripple is less, this is suitable for accurate measurement. In FIGS. 8A and 8B, a solid line expresses a pass characteristics (amplitude), a broken line expresses a group delay characteristics.

FIG. 4 is a diagram illustrating an example of a band pass filter in which eight stages of conventional ¼ wavelength (λ/4) lines are side-coupled, and it is a Chebyshev type filter. FIG. 5 is a diagram illustrating its high-frequency characteristics, and in this example, insertion loss at 2 GHz is 0.8059 dB, a group delay time is 2.4585 ns, and the fractional bandwidth (3 dB pass-bandwidth/pass center frequency) is about 45%. Since the fractional bandwidth of a one-stage band pass filter which is constituted by a ¼ wavelength line is generally about 15%, a number of the stages in this example is set to eight in order to extend the band, but on the contrary, a circuit is enlarged, thereby increasing insertion loss. Further, in the Chebyshev type filters, when the passband is made to be flat, the group delay characteristics do not become constant, and thus the waveform is easily distorted.

FIG. 6 is diagram illustrating an example of a band pass filter in which six stages of conventional ¼ wavelength (λ/4) lines are side-coupled, and it is a Butterworth type filter. FIG. 7 illustrates its high-frequency characteristics, and in this example, insertion loss at 2 GHz is 0.664 dB, a group delay time is 1.9995 ns, and the fractional bandwidth is about 32%. In order to obtain cut-off characteristics which are as steep as possible by enlarging the fractional bandwidth, the number of stages is six, but for this reason, the circuit size is increased, and the insertion loss increases. The steepness on the cut-off band is inferior to that in the Chebyshev type, but the group delay characteristics are satisfactory and are approximately constant in the passband, and thus the waveform is hardly distorted. In the band pass filter which is constituted by the conventional microstriplines, since the resonance frequency is determined by ¼ wavelength, it is difficult to extend the band (about 15%). Further, when a number of stages is increased in order to extend the fractional bandwidth, the circuit size is increased and the insertion loss increases, and thus this filter is not suitable for MIC and MMIC.

Further, in order to remove disadvantages that a shape of the band pass filters in which a plurality of conventional ¼ wavelength lines are side-coupled is large and the insertion loss is large, a dual-mode filter which uses a ring resonator is known (see Japanese Patent Application Laid-Open No. 9-139612). This filter is small, but it has an essential problem such that the band is narrow. That is to say, in the conventional filters using the ring resonators, since impedance becomes minimum at the resonance frequency, only the resonance portion passes, the other band portions are rejected. Due to its properties, therefore, the passband must be narrow.

On the other hand, a band rejection filter which does not allow only a signal at a specified frequency to pass and allows signals at the other frequencies to pass is known, but this band rejection filter does not allow only signals at a specified frequency (attenuation pole frequency) and at frequencies within a narrow range before and after the specified frequency to pass, and allows signals at the other frequencies to pass. For this reason, when this filter is used as the band pass filter, it can be a wideband band pass filter. In the band rejection filter, however, since a frequency band which rejects the passing is narrow, it has a problem such that it also allows signals which are not desired to be passed to pass. Particularly, this filter cannot be used for the case where a DC component should be removed.

Conventionally-known filters that reject the DC component include a filter that uses a ¼ wavelength short stub shown in FIG. 13. This filter can remove the DC (and frequency which is two times as high as pass center frequency) component as shown in FIG. 14, but reflection frequently occurs at frequencies other than the pass center frequency (see $S_{11}$), and the loss is large. A filter which rejects the DC component and has less reflection (loss) at the passband is, therefore, desired. FIG. 14A illustrates a simulation result, and FIG. 14B illustrates actual measurement data.

The present invention is devised in order to solve the problems of the conventional band pass filter and band rejection filter, and its object is to provide a filter in which insertion loss is small in wideband, a passband is flat, steep attenuation is obtained and a DC component can be removed, and a high-frequency band pass filter utilizing this filter.

SUMMARY OF THE INVENTION

The present invention relates to a ring filter, and the object of the present invention is achieved by a ring filter characterized in that an input terminal of a high-frequency signal is provided to an arbitrary point on a line in a microstripline ring resonator having the line with an electrical length of one wavelength, an output terminal is provided to a point which is positioned at a half wavelength at electrical length from the input terminal, a open stub of ¼ wavelength at electrical length is connected to a point positioned at ¼ wavelength at electrical length from the input terminal. FIGS. 1A and 1B illustrate one example of this ring filter.

This ring filter operates as a band rejection filter, and as shown in FIG. 9, a passband is flat and steep attenuation is obtained.

Further, the object of the present invention is achieved also by a ring filter, characterized in that an input terminal of a high-frequency signal is provided to an arbitrary point on a line in a microstripline ring resonator having the line with an electrical length of one wavelength, an output terminal is provided to a point which is positioned at a half wavelength at electrical length from the input terminal, one end of a stub of half wavelength at electrical length is connected to a point which is positioned at ¼ wavelength at electrical length from the input terminal, and the other end of the stub is grounded.

FIG. 2 illustrates this example. This ring filter operates as the band rejection filter, and as shown in FIG. 10, the passband is flat, steep attenuation can be obtained, and a DC component is rejected.

Further, the object of the present invention is effectively achieved by the ring filter, characterized in that a ratio of characteristic impedance of the ring resonator to characteristic impedance of the stub is changed so that an attenuation pole frequency is adjusted, and a passband width can be variable. Concretely, the attenuation pole frequency is determined by a mathematical expression 2, mentioned later, but in FIG. 3, $Z_1$ and $Z_2$ are fixed and only the impedance of the stub ($Z_3$ in the mathematical expression 2) is changed, so that the attenuation pole frequency is changed.

Further, the object of the present invention is effectively achieved by the ring filter, characterized in that when impedance of an input and an output to/from the ring resonator is designated by $Z_0$, impedance of the line not connected with the stub in the half-wavelength line from the input terminal to the output terminal in the ring resonator is designated by $Z_1$, and impedance of the ¼ wavelength line from the input terminal to the connecting point of the stub is designated by $Z_2$, $Z_0$, $Z_1$ and $Z_2$ satisfy the following inequality:

$$Z_2/Z_0 \leqq 1 \qquad \text{(Mathematical expression 1)}$$

$$\left\{1+\sqrt{(1+4(Z_2/Z_0)^2)}\right\}/(2Z_2/Z_0) < (Z_1/Z_0)$$

$$Z_2/Z_0 > 1$$

$$\left\{1+\sqrt{(1+4(Z_2/Z_0)^2)}\right\}/(2Z_2/Z_0) < (Z_1/Z_0) < (Z_2/Z_0)/(Z_2/Z_0-1)$$

The ring filter which satisfies the inequality (mathematical expression 1) does not generate ripples in the passband regardless of a value of the characteristics impedance of the stub.

Further, the object of the present invention is achieved by a ring filter, characterized in that an input terminal of a high-frequency signal is provided to an arbitrary point on a line in a microstripline ring resonator having the line with an electrical length of one wavelength, an output terminal is provided to a point which is positioned at a half wavelength at electrical length from the input terminal, one end of a stub of ¼ wavelength at electrical length is connected to a point which is positioned at ¼ wavelength at electrical length from the input terminal, and the other end of the stub is grounded.

FIG. 15 illustrates this example. This ring filter operates as the band rejection filter, and as shown in FIG. 16, ripple is not generated in the passband and thus the passband is flat, and a DC component (and a frequency component which is as high as a pass center frequency) is rejected. Reflection (loss) is less in the passband. FIG. 16A illustrates simulation results, and FIG. 16B illustrates actual measurement data.

A shape of the ring resonator may be any one of circular, elliptic and quadrate shapes.

The present invention relates to a wideband band pass filter using the ring filter, and the object of the present invention is achieved by a band pass filter which is constituted so that a plurality of the ring filters are selected from the ring filters regardless of types and overlapping and they are connected by cascade connection, characterized in that attenuation pole frequencies of the connected ring filters are different from one another.

FIG. 3 illustrates an example of a band pass filter using a ring filter according to the present disclosure, wherein five ring filters connected to the open stub of ¼ wavelength each are connected by a cascade connection, and the attenuation pole frequencies of the ring filters are different from one another.

The example in FIG. 3 shows the case where all the five ring filters have the open stub, but the ring filter with open stub and a ring filter with a half-wavelength short stub may be combined.

Further, the object of the present invention is more effectively achieved by a band pass filter which is connected to at least one ring filter having a short stub of ¼ wavelength by cascade connection.

FIG. 17 illustrates an example of the band pass filter which is constituted so that four stages of the ring filters connected to the open stub of ¼ wavelength are connected by cascade connection with the attenuation pole frequencies of the ring filters being different, and further one ring filter connected to a short stub of ¼ wavelength is connected by cascade connection.

BRIEF DESCRIPTION OF THE DRAWINGS

FIG. 8 is a diagram illustrating characteristics of a general band pass filter.

FIG. 14 is a diagram illustrating high-frequency characteristics (pass characteristics, reflecting characteristics) of the DC component removing filter according to the conventional example shown in FIG. 13.

FIG. 18 illustrates ripple characteristics in the vicinity of the passband when $Z_0$=50Ω, $Z_1$=16Ω, $Z_2$=90Ω and $Z_3$=22.14Ω in the ring filter in FIG. 1.

BEST MODE FOR CARRYING OUT THE INVENTION

It is an object of the present invention to realize a wideband band pass filter using a microstripline, but since a conventional band pass filter utilizes a property such that impedance becomes the smallest at a resonance frequency, it can allow only signals at frequencies in a narrow range around the resonance frequency to pass. The band pass filter, however, which is devised based on the idea that it allows a signal to pass at the time of resonance, has a limitation in widening the band.

In the present invention, therefore, a band rejection filter that does not allow only a signal at a specified frequency to pass and allows signals at other frequencies to pass is used so as to extend the band of the band pass filter. That is to say, since the band rejection filter does not allow to pass only a signal at a specified frequency (attenuation pole frequency) or at frequency in a narrow range before and after the specified frequency to pass and allows signals at other frequencies, when it is used as a band pass filter, it becomes a wideband band pass filter.

Since, however, the cut-off band of the band rejection filter is narrow, this filter allows even signals at frequencies which are not desired to be passed to pass. In the present invention, therefore, several types of band rejection filters with different attenuation pole frequencies are connected by cascade connection so as to form a multistage filter, and as a whole, the cut-off band becomes wide, so that this problem is solved. It is a serious design problem whether the attenuation pole frequencies of the respective band rejection filters can be freely set to desired values, but as mentioned later, since the attenuation pole frequency can be obtained by calculation based on characteristic impedance of a ring portion of the band rejection filter (ring filter) according to the present invention and characteristic impedance of a stub portion, when a design value of the attenuation pole frequency and the characteristic impedance of the ring portion are given, the characteristic impedance of the stub portion can be calculated backward. This means that the attenuation pole frequency can be controlled only by changing the characteristic impedance of the stub (with the characteristic impedance of the ring portion being constant), and this is the great merit of the design.

The band pass filter of the present invention is explained in detail with reference to the drawings.

Figure 1A:
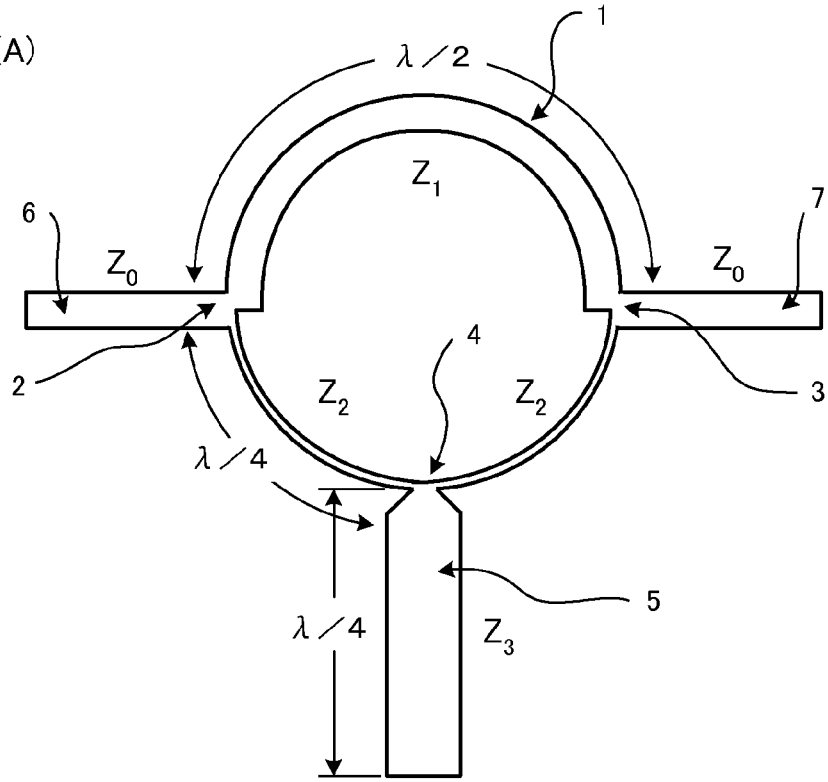
FIGS. 1A and 1B are pattern diagrams illustrating a ring filter as a band rejection filter according to an embodiment of a first invention.
Figure 1B:
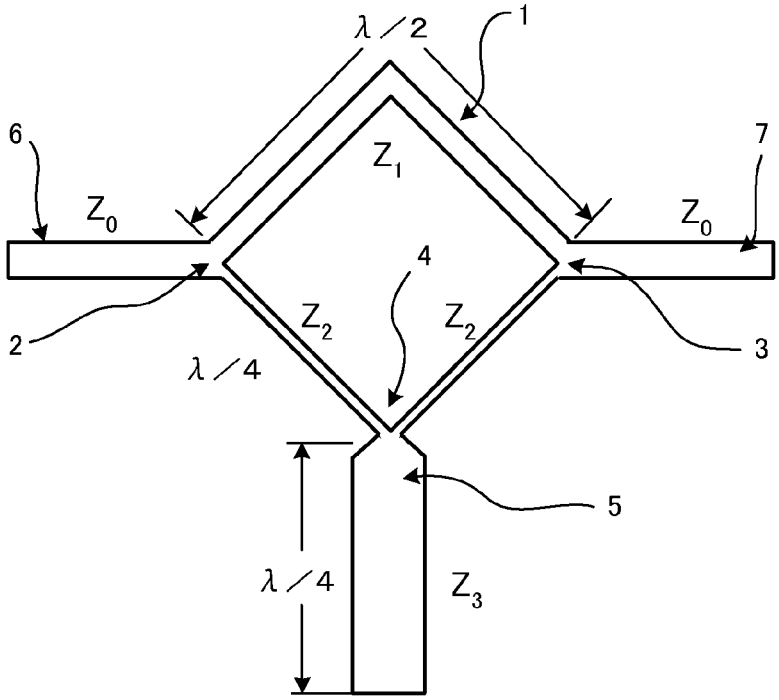

FIGS. 1A and 1B are pattern diagrams illustrating a ring filter as the band rejection filter according to an embodiment of the first invention. In the drawing, "1" designates a ring resonator which is constituted by a microstripline whose electrical length is one wavelength (λ) at pass frequency, an input terminal 2 and an output terminal 3 are provided to a position λ/2 separated at the electrical length on a periphery of the ring resonator, and a open stub 5 with electrical length of λ/4 is connected to a position 4 located λ/4 at electrical length apart from the input terminal 2 on the periphery of the ring. Hereinafter, all the line lengths mean the electrical lengths unless otherwise noted. As a result, one side circuit can be separated at an equally-spaced point in a pass band, and a transmission line with λ/2 length at pass frequency can be formed between transmission lines.

When the characteristic impedance of the upper ring portion in the ring filter is designated by $Z_1$, the characteristic impedance of the lower ring portion is designated by $Z_2$ and the characteristic impedance of the open stub 5 is designated by $Z_3$, an attenuation pole frequency f is obtained according to the following mathematical expression 2:

$$\tan^2\theta_p = 2(1+Z_1/Z_2)(Z_3/Z_2)$$

$$f = \theta_p{}^\circ/90^\circ \times f_0(\text{GHz}) \qquad \text{(Mathematical expression 2)}$$

$f_0$: center frequency $\theta_p$: electrical angle of the cut-off frequency

EMBODIMENT

The ring filter in FIG. 1 was realized by a high-frequency circuit board whose specific inductive capacity is 3.5, board thickness is 1.67 mm, conductor thickness is 35 μm and dielectric loss is 0.025. An effective radius of the ring is 15 mm, and a length of the open stub is about 20 mm. At this time, as to each characteristic impedance, $Z_1$=50Ω, $Z_2$=131.8Ω, and $Z_3$=24.6Ω.

Figure 9:
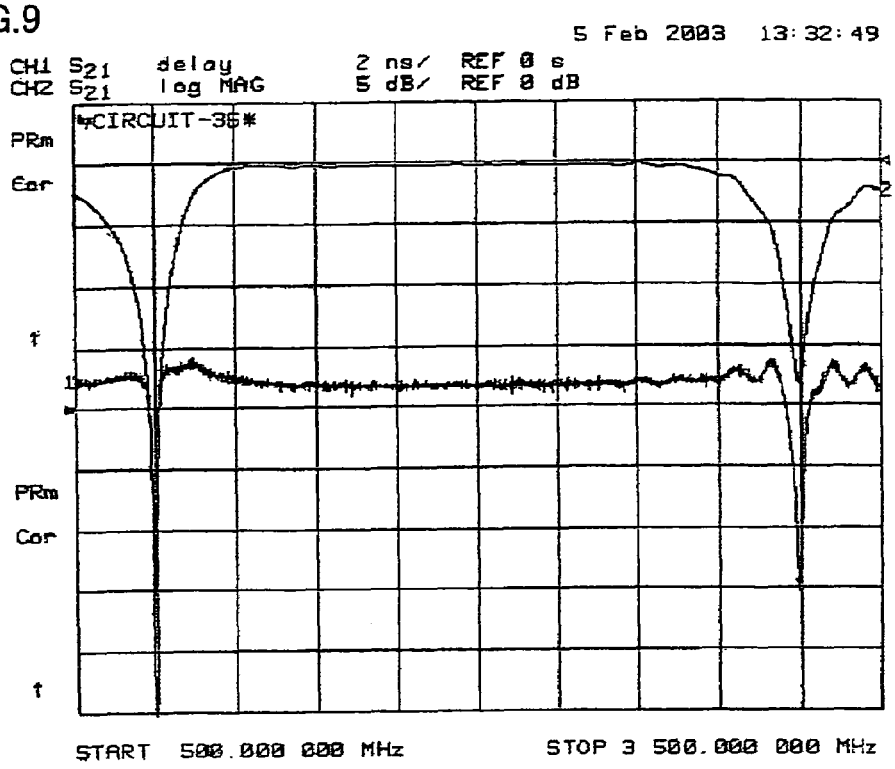
FIG. 9 is a diagram illustrating the high-frequency characteristics of the ring filter in the case where $Z_1$=50Ω, $Z_2$=131.8Ω and $Z_3$=24.6Ω in FIG. 1.

The high-frequency characteristics of the ring filter are as shown in FIG. 9 (the upper side shows pass characteristics, and lower side shows group delay characteristics). The pass loss at 2 GHz band is about 0.28 dB, the attenuation pole frequency is about 800 MHz and about 3200 MHz, and thus it is found that the attenuation pole frequency is in good agreement with the theoretical values (792 MHz and 3208 MHz) obtained by the mathematical expression 2. Further, the fractional bandwidth exceeds 100%, and the group delay characteristics is 2 GHz±0.4 GHz, namely about 1 ns (constant), which is an approximately value of the transmission line. FIG. 1A shows the case of a circular ring, and FIG. 1B shows the case of a rectangular ring, but the present invention is not limited to them, and the ring shape is not limited as long as the ring has the same electrical length and the same impedance. Microstriplines 6 and 7 connected to the input terminal 2 and the output terminal 3 are provided in order to suppress reflection of signals, and their characteristic impedance $Z_0$ does not influence the attenuation pole frequency as is clear from the mathematical expression 2.

Figure 2:
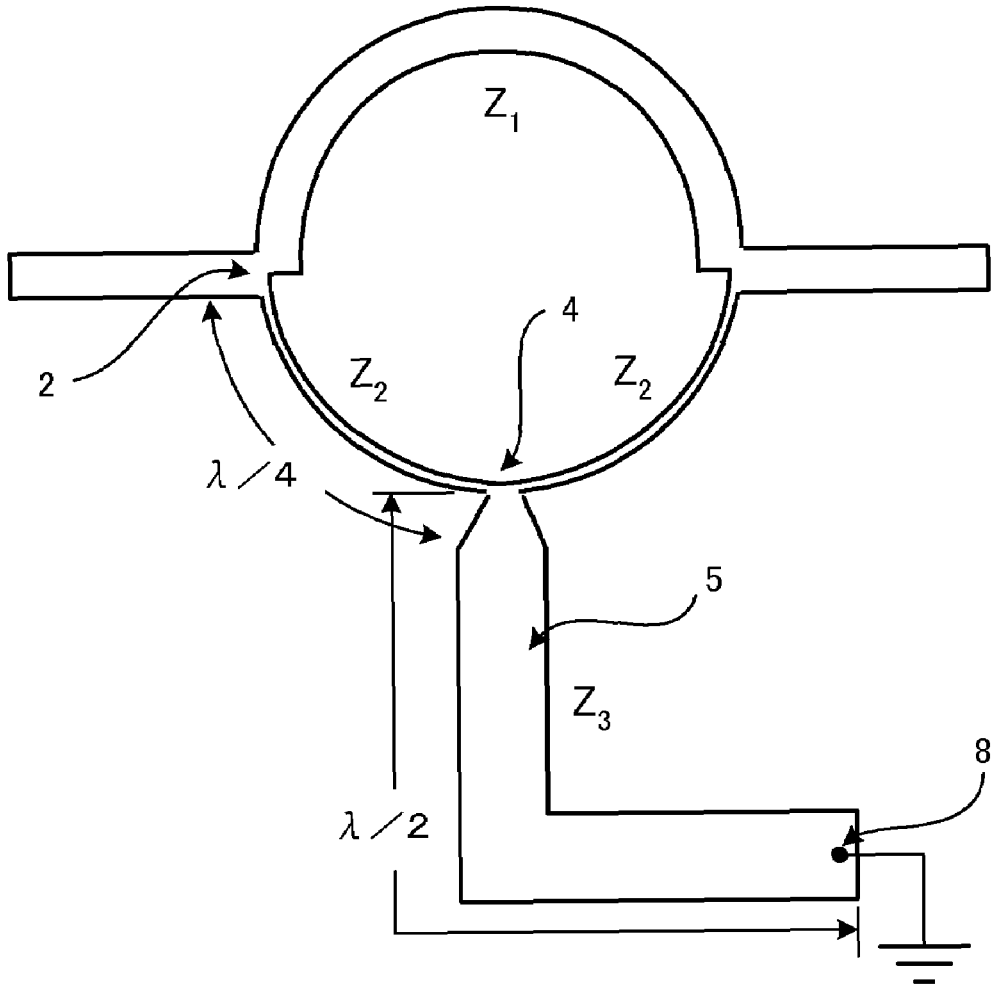
FIG. 2 is a pattern diagram illustrating the ring filter as the band rejection filter according to an embodiment of a second invention.
Figure 10:
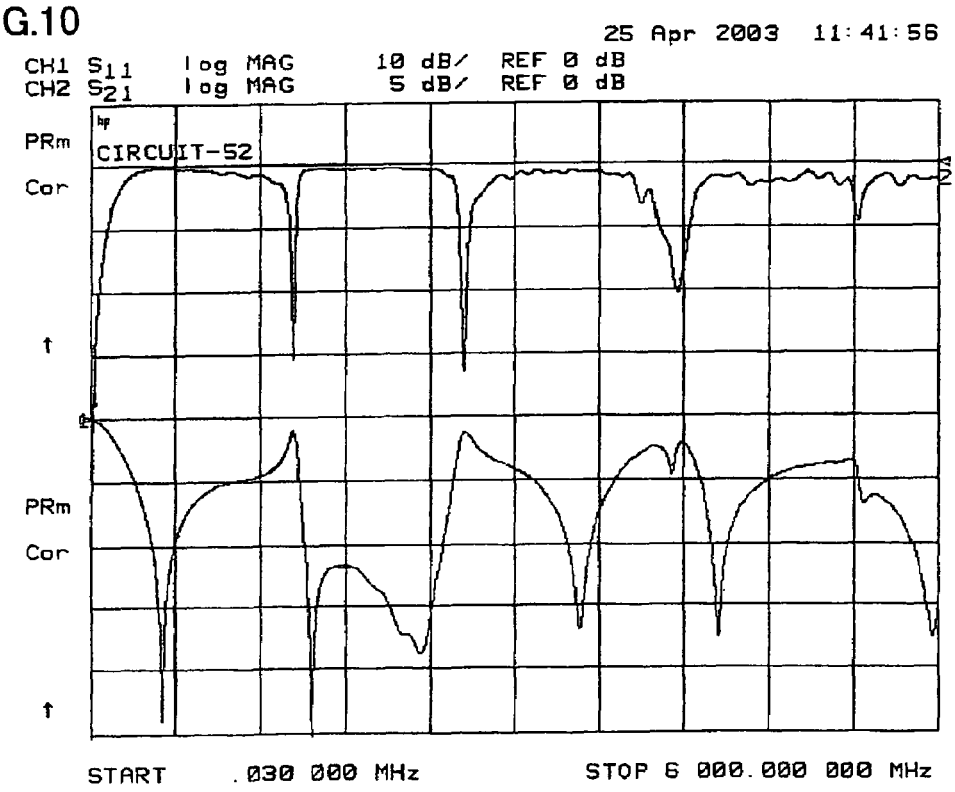
FIG. 10 is a diagram illustrating high-frequency characteristics of the ring filter in the case where $Z_1$=50Ω, $Z_2$=131.8Ω and $Z_3$=70.7Ω in FIG. 2.

FIG. 2 is a pattern diagram illustrating the ring filter as the band rejection filter according to an embodiment of the second invention. Its difference from the first invention in FIG. 1 is that the length of the stub 5 connected to the position 4 located λ/4 apart from the input terminal 2 is λ/2, and its end 8 is grounded. In the ring filter with open stub according to the first invention, a interval of the attenuation pole frequency can be widened, but when the frequency is 0, attenuation does not occur, but in the ring filter with short stub according to the second invention, the interval of the attenuation pole frequency cannot be as wide as the case of the open stub, but when the frequency is 0 (and the frequency which is two times as high as the pass center frequency), a signal is prevented from passing. This filter is utilized in a circuit in which also a DC component should be cut. FIG. 10 is a plot when $Z_1$=50Ω, $Z_2$=131.8Ω and $Z_3$=70.7Ω in the ring filter in FIG. 2 (the upper side shows pass characteristics, and the lower side shows reflecting characteristics). When the pass center frequency is 2 GHz, the attenuation pole frequency is about 1.4 GHz and 2.6 GHz, and thus the interval of the attenuation pole frequency is narrower than the case of the open stub (800 MHz and 3.2 GHz), but it is found that attenuation occurs when the frequency is 0 and 4 GHz (=frequency which is two times as high as the pass center frequency).

Figure 3:
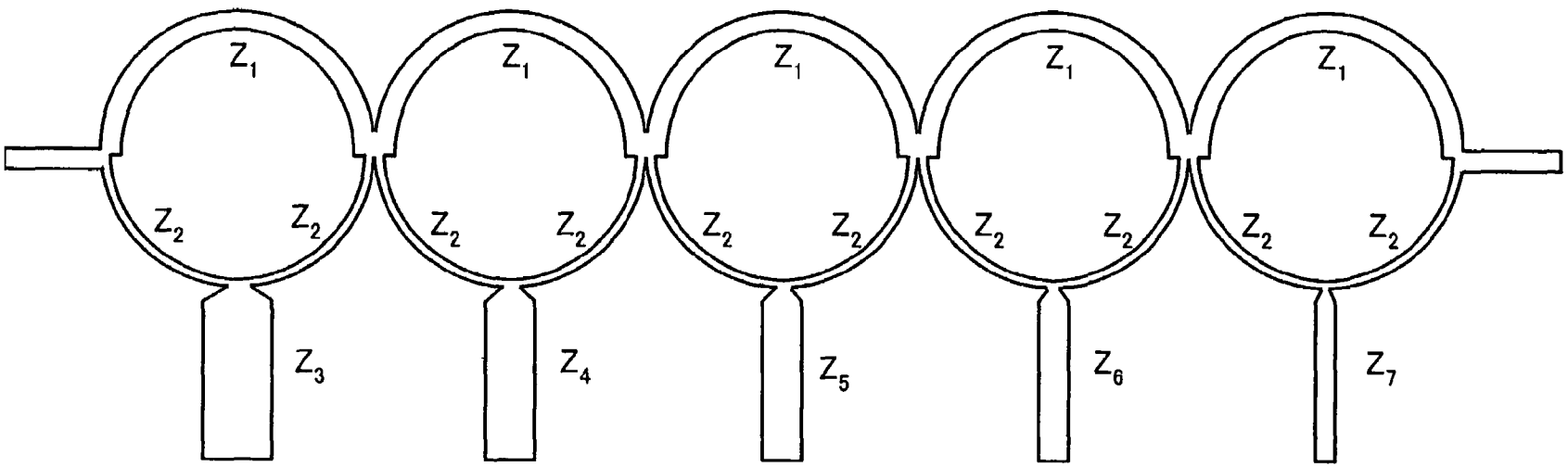
FIG. 3 illustrates a wideband band pass filter constituted so that five ring filters with open stubs in FIGS. 1A and 1B are connected by cascade connection.
Figure 4:
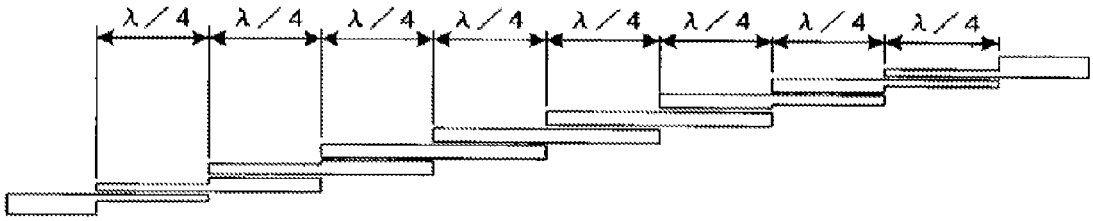
FIG.4 PRIOR ART
FIG. 4 is a diagram illustrating an example of a band pass filter (Chebyshev type) in which eight stages of conventional ¼ wavelength lines are side-coupled.
Figure 5:
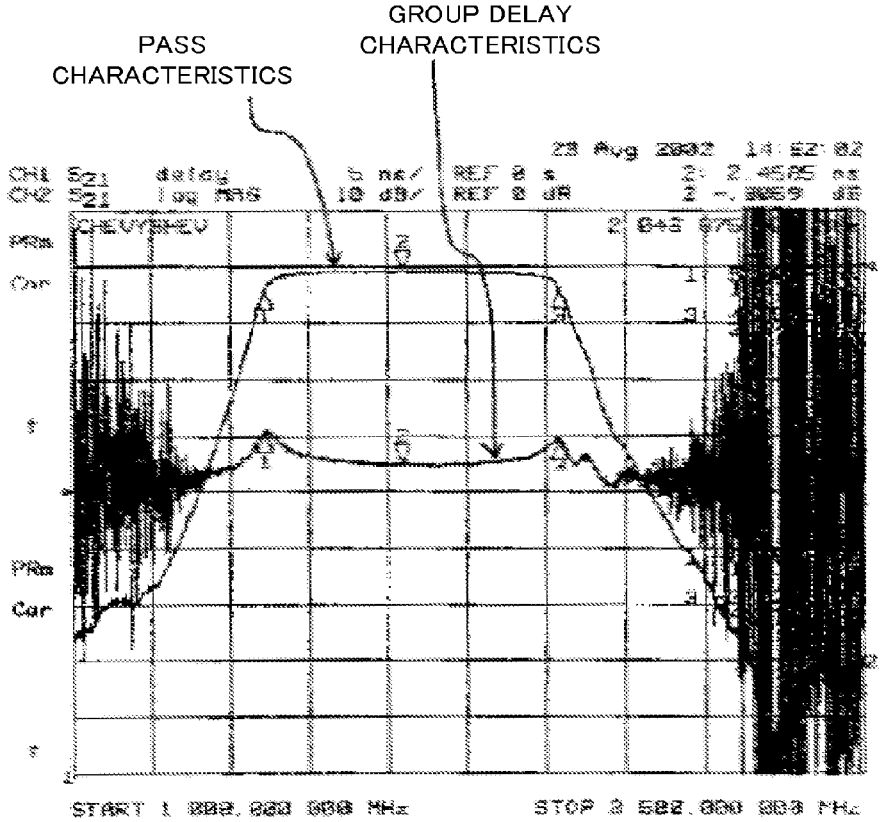
FIG.5 PRIOR ART
FIG. 5 is a diagram illustrating high-frequency characteristics of the band pass filter in FIG. 4.
Figure 6:
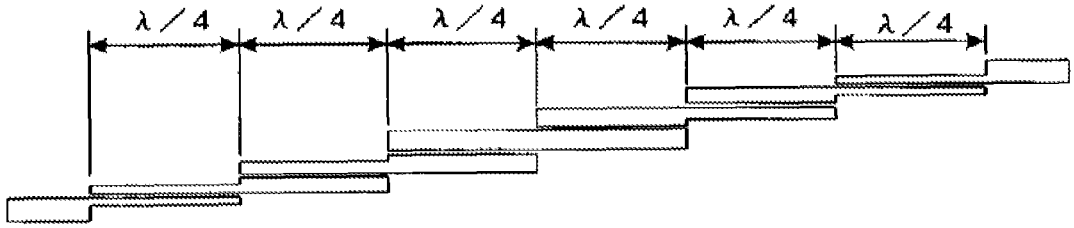
FIG.6 PRIOR ART
FIG. 6 is a diagram illustrating an example of a band pass filter (Butterworth type) in which six stages of the conventional ¼ wavelengths lines are side-coupled.
Figure 7:
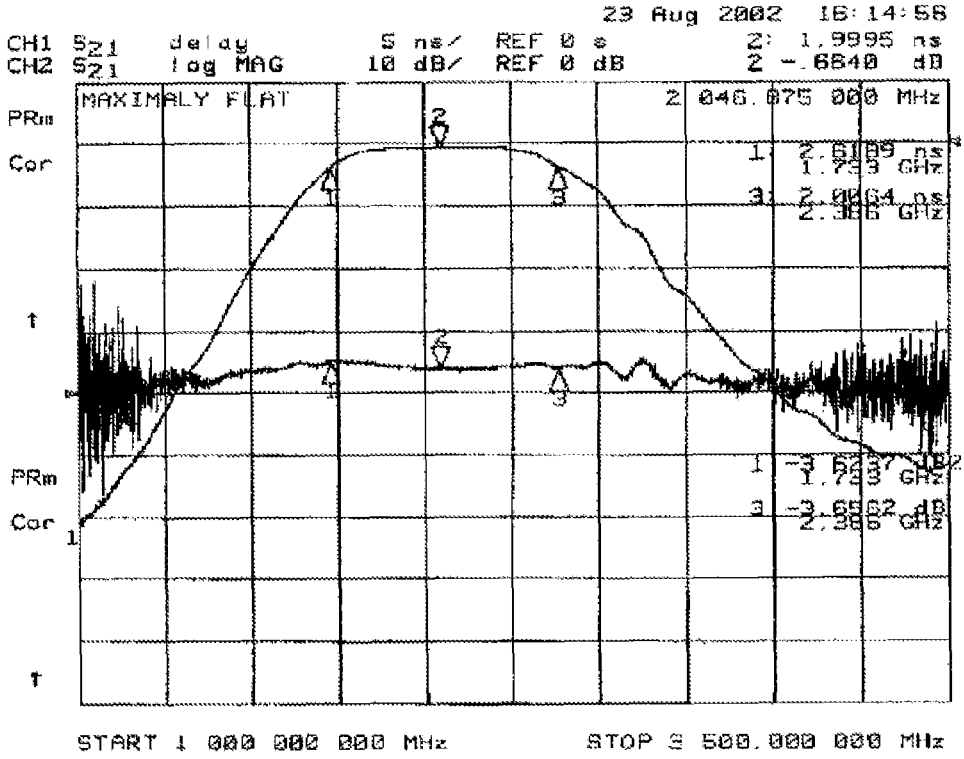
FIG.7 PRIOR ART
FIG. 7 is a diagram illustrating high-frequency characteristics of the band pass filter in FIG. 6.
Figure 8A:
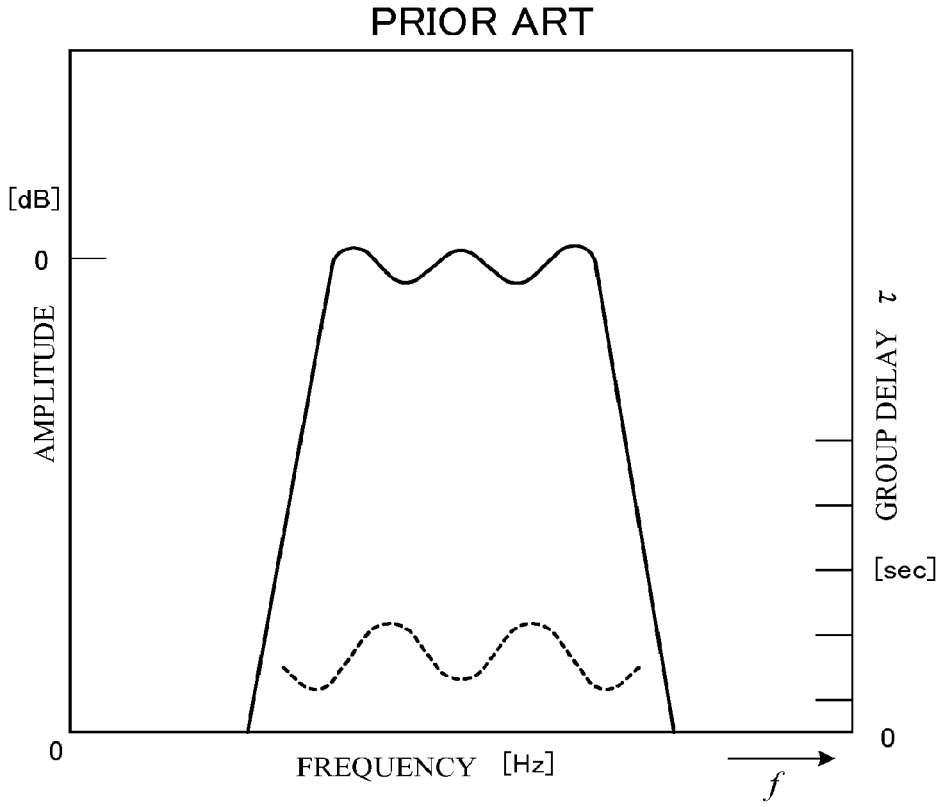
FIG. 8A shows a Chebyshev characteristic.
Figure 8B:
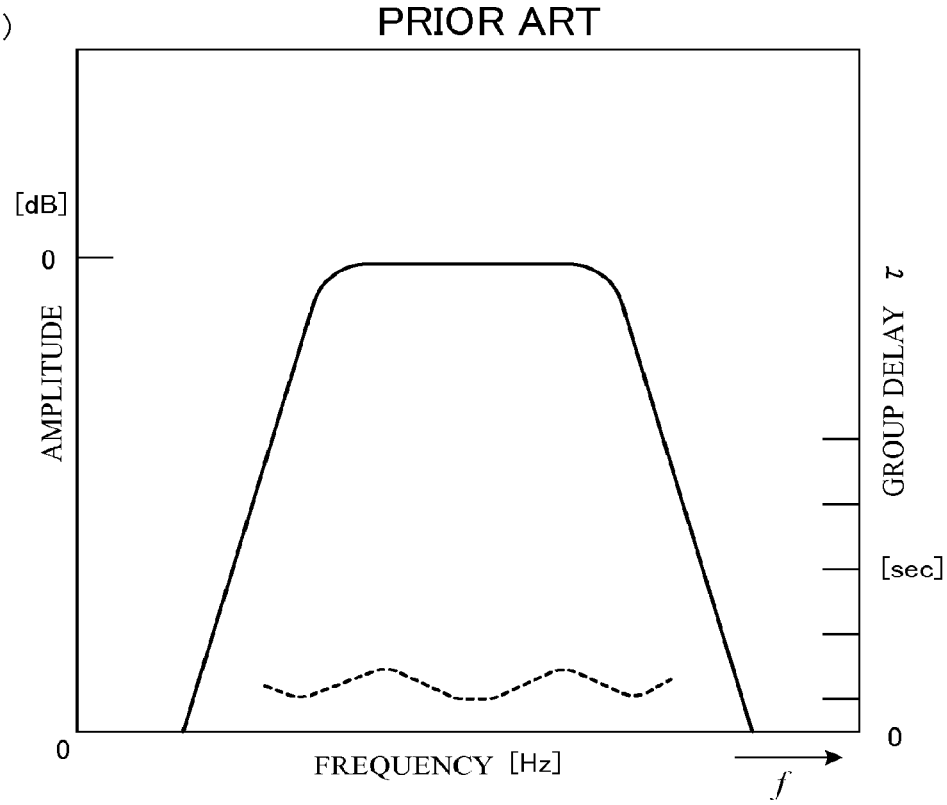
FIG. 8B shows a Butterworth characteristic.
Figure 11:
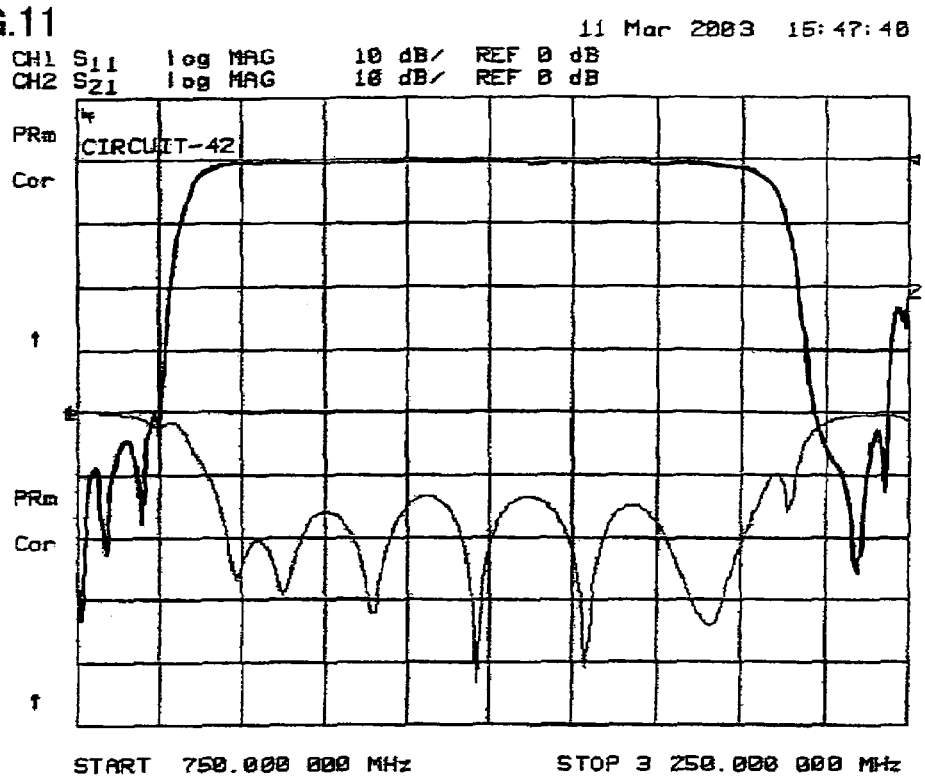
FIG. 11 is a diagram illustrating high-frequency characteristics (pass characteristics, reflecting characteristics) of the band pass filter according to the embodiment shown in FIG. 3.
Figure 12:
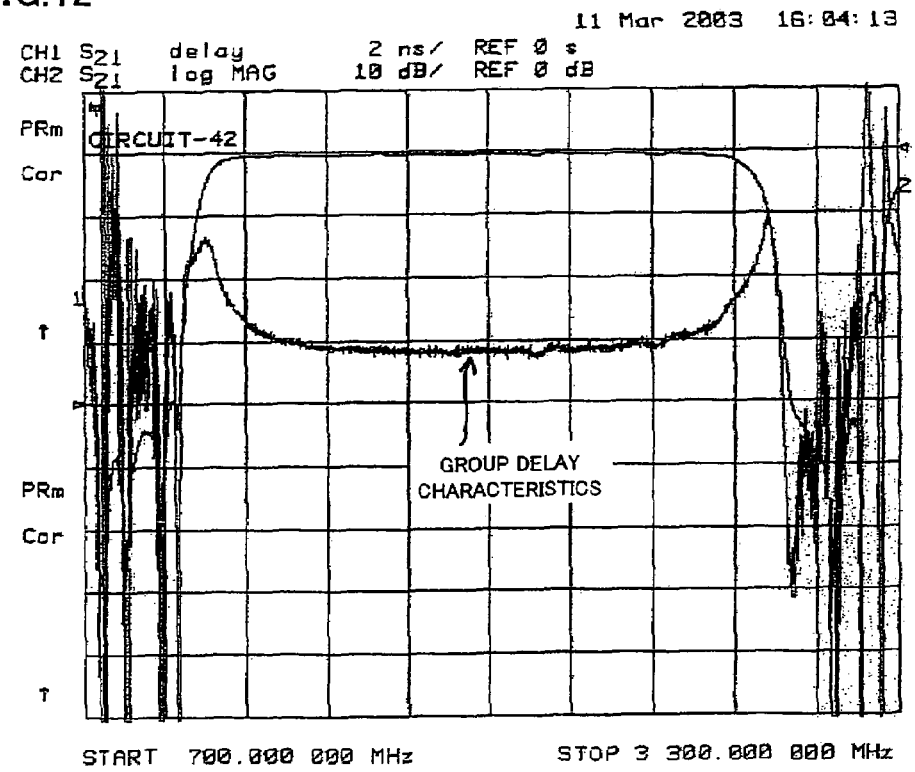
FIG. 12 is a diagram illustrating high-frequency characteristics (pass characteristics, group delay characteristics) of the band pass filter according to the embodiment shown in FIG. 3.

FIG. 3 illustrates the wideband band pass filter in which the five ring filters with open stub in FIG. 1 are connected by cascade connection according to the embodiment. Since attenuation pole frequencies are different from one another, a stop frequency domain can be totally widened by the cascade connection. In FIG. 3, the characteristics of the band pass filter in the case where $Z_1$=50Ω, $Z_2$=131.8Ω, $Z_3$=20Ω, $Z_4$=24.6Ω, $Z_5$=30Ω, $Z_6$=40Ω and $Z_7$=50Ω are as shown in FIG. 11 (the upper side shows pass characteristics, and the lower side shows reflecting characteristics). The passband is flat, and the fractional bandwidth is about 85%. Further, it is found that the stop band is widened. The group delay characteristics are approximately constant at 2 GHz±0.5 GHz a shown in FIG. 12.

The generating condition of the ripple in the passband was examined, and design parameters that prevent ripple from being generated were obtained, so that the generating condition was verified based on actual measurement data.

In the ring filter shown in FIGS. 1 and 2, the condition that prevents the ripple from being generated in the pass band is that no matching pole is present. The matching pole is obtained by setting $S_{11}$ of S parameter to 0. When the electrical angle of the matching pole is designated by θm, $\tan^2\theta m$ is expressed by the following mathematical expression 3 (halfway expression is omitted).

$$\tan^2\theta_m = \frac{2(Z_3/Z_2)\{(Z_1/Z_0)^2-(1+Z_1/Z_2)^2\}-(Z_1/Z_2)(1+Z_1/Z_2)}{(Z_1/Z_0)^2-(1+Z_1/Z_2)} \quad \text{(Mathematical expression 3)}$$

When an attention is paid to the mathematical expression 3, since the left part ≧0, a condition that the solution of the matching pole θm is not present is right part <0. The denominator and numerator of the fractional expression on the right part should be different sign. This includes the two cases. That is to say, (1) denominator <0 and numerator >0 or (2) denominator >0 and numerator <0.

When the case (1) is examined, in the case where denominator <0. $(Z_1/Z_0)^2<(1+Z_1/Z_2)$ . . . (i) is established.

Further, since $Z_1$ and $Z_2$ are positive, $(1+Z^1/Z_2)<(1+Z_1/Z_2)^2$ . . . (ii) is always established.

According to (i) and (ii), $(Z_1/Z_0)^2<(1+Z_1/Z_2)<(1+Z_1/Z_2)^2$, and $(Z_1/Z_0)^2-(1+Z_1/Z_2)^2<0$ . . . (iii) is always established.

Since the left part of (iii) is a coefficient of the numerator $(Z_3/Z_2)$ on the right part of the expression 3, the numerator of the right part in the expression 3 becomes negative regardless of the value of $Z_3$. The case (1), therefore, cannot be satisfied.

When the case (2) is examined, in the case where denominator >0, $(1+Z_1/Z_2)<(Z_1/Z_0)^2$ . . . (iv) is established.

Further, in order that the numerator of the right part in the expression 3 becomes negative regardless of the value $Z_3$, it is a necessary and sufficient condition that (iii) is established.

According to (iii), $Z_1/Z_0<1+Z_1/Z_2$ . . . (v) is derived.

In (iv) and (v), when the expression are replaced by $Z_1/Z_2=(Z_1/Z_0)/(Z_2/Z_0)$ and the respective inequalities are solved, the followings are obtained.

When (iv) is solved, the following mathematical expression 4 is established:

$$(Z_1/Z_0) > \left\{1+\sqrt{(1+4(Z_2/Z_0)^2)}\right\}\Big/(2Z_2/Z_0) \quad \text{(Mathematical expression 4)}$$

When (v) is solved, the following two solutions are obtained. That is to say, in (v):

$$Z_1/Z_0<1+Z_1/Z_2=1+(Z_1/Z_0)/(Z_2/Z_0),$$

$$(Z_1/Z_0)\{(Z_2/Z_0)-1\}<(Z_2/Z_0) \text{ . . . (vi), therefore,}$$

in the case where $(Z_2/Z_0)>1$, $(Z_1/Z_0)<(Z_2/Z_0)/\{(Z_2/Z_0)-1\}$ . . . (vii), in the case where $(Z_2/Z_0)<1$, always established When the above contents are summarized, the condition where the ripple is not generated in the passband regardless of value $Z_3$ is the mathematical expression 1.

EMBODIMENT

In order to verify appropriateness of the mathematical expression 1 as the conditional expression that prevents the ripple from being generated, the characteristic impedance of the ring filter were variously changed so that a simulation was done.

Figure 18A:
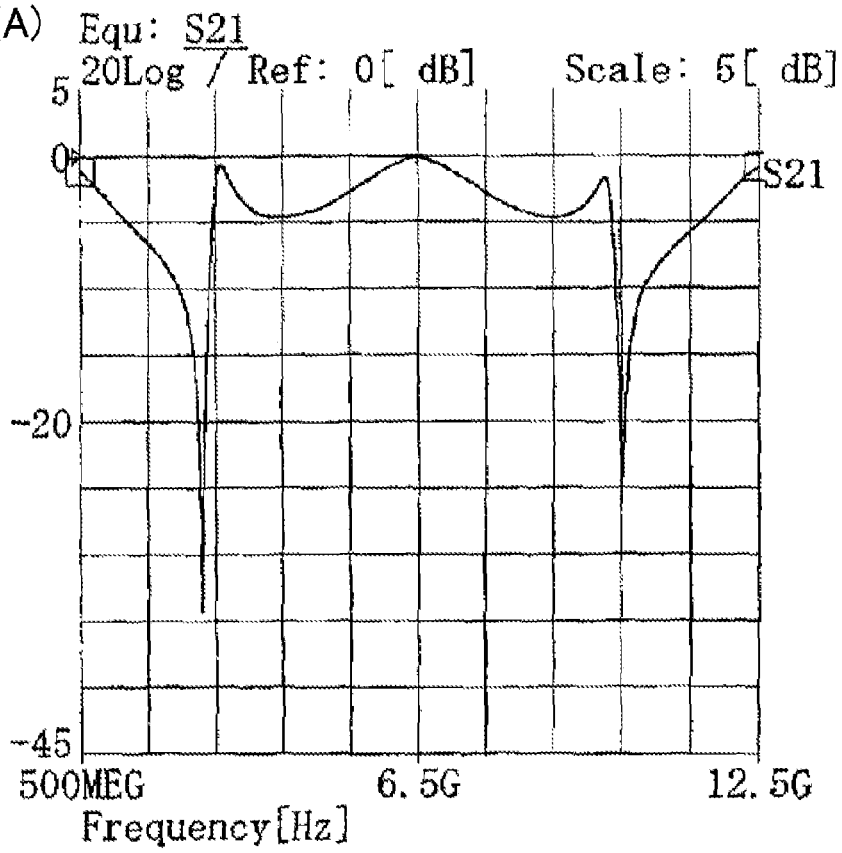
FIG. 18A illustrates a simulation result by a computer.
Figure 18B:
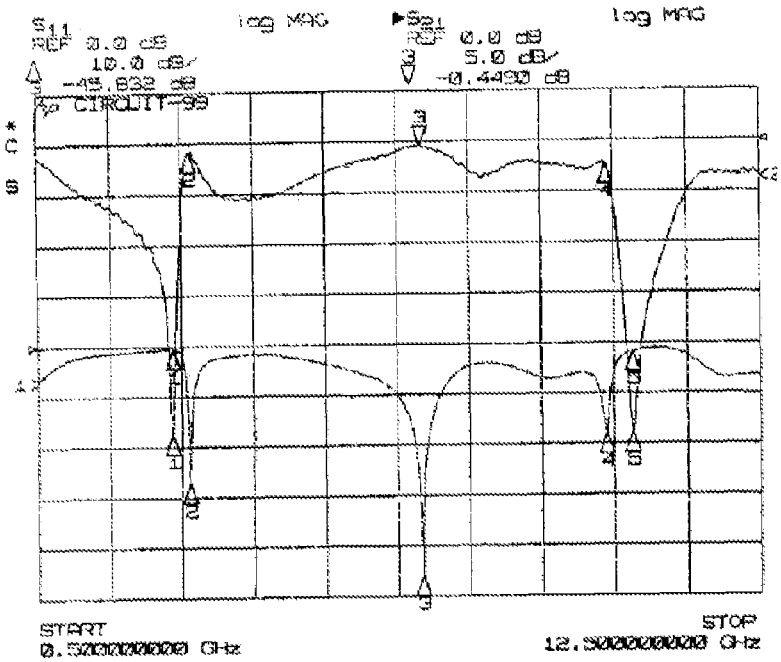
FIG. 18B illustrates actual measurement data by a network analyzer.

FIG. 18 illustrates high-frequency characteristics in the vicinity of the passband when $Z_0$=50Ω, $Z_1$=16Ω, $Z_2$=90Ω and $Z_3$=22.14Ω in the ring filter in FIG. 1, FIG. 18A shows a simulation result by a computer, and FIG. 18B shows actual measurement data by a network analyzer. The result and the data are extremely approximated, and they obviously prove high reliability of the simulation.

In the ring filter in FIG. 1, $Z_0$, $Z_2$ and $Z_3$ are fixed to 50Ω, 90Ω and 22.14Ω, respectively, and only $Z_1$ is changed so that the ripple occurrence state is verified by a simulation. FIGS. 19A and 19B, and FIGS. 20A and 20B are diagrams illustrating simulation results when $Z_1$ is 50Ω, 60Ω, 65.79Ω and 70Ω. Since $Z_2/Z_0$=1.8, the second expression of the mathematical expression 1 is applied to the conditional expression that prevents the ripple.

(1) In the case where $Z_1$=50Ω

Since the left part of the mathematical expression 4 is 1 and the right part is 1.3156 (is not related with $Z_1$), the mathematical expression 4 is not satisfied (the mathematical expression 1 is not, therefore, satisfied), the matching pole is present, and thus the ripple is theoretically generated.

Figure 19A:
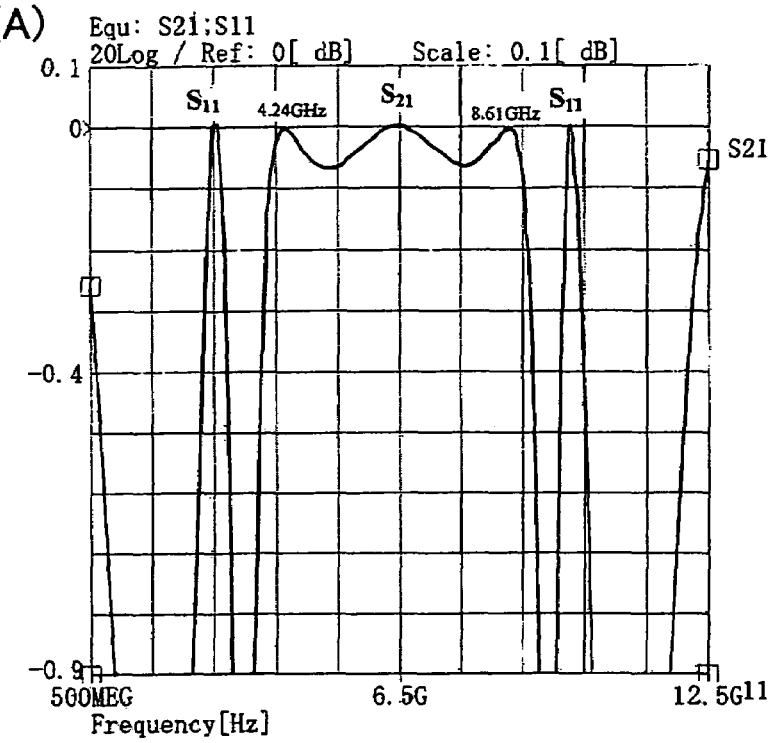
FIG. 19A is a simulation chart of the ripple characteristics in the vicinity of the passband when $Z_0$=50Ω, $Z_1$=50Ω, $Z_2$=90Ω and $Z_3$=22.14Ω in the ring filter in FIG. 1.

As is shown in FIG. 19A, the matching pole is at 4.24 GHz and 8.61 GHz, and it is found that the ripple is generated in the passband.

(2) In the case where $Z_1$=60Ω

Since the left part of the mathematical expression 4 is 1.2 and the right part is 1.3156 (is not related with $Z_1$), the mathematical expression 4 is not satisfied (the mathematical expression 1 is not, therefore, satisfied), the matching pole is present and thus the ripple is theoretically generated.

Figure 19B:
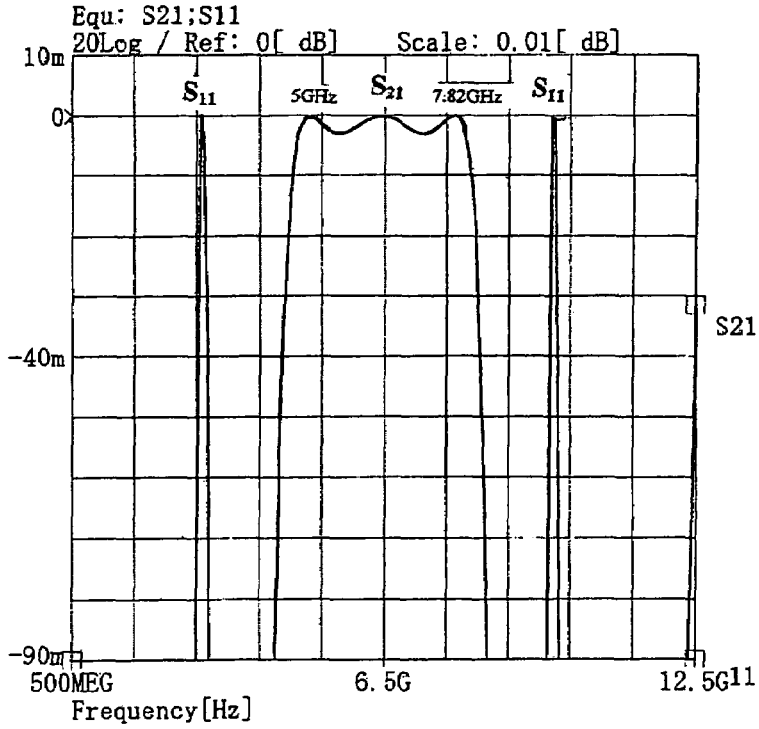
FIG. 19B is a simulation chart of the ripple characteristics in the vicinity of the passband when $Z_0$=50Ω, $Z_1$=60Ω, $Z_2$=90Ω and $Z_3$=22.14Ω in the ring filter in FIG. 1.

As is clear from FIG. 19B, the matching pole is at 5 GHz and 7.82 GHz, and the ripple is generated in the passband.

(3) In the case where $Z_1$=65.79Ω

Figure 20A:
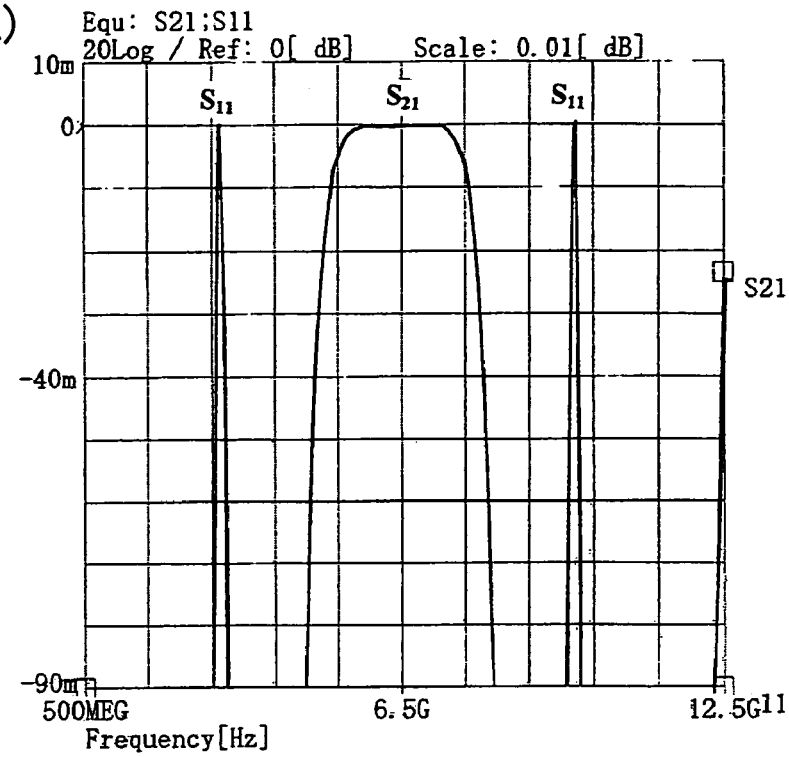
FIG. 20A is a simulation chart illustrating the ripple characteristics in the vicinity of the passband when $Z_0$=50Ω, $Z_1$=65.79Ω, $Z_2$=90 q and $Z_3$=22.14Ω in the ring filter in FIG. 1.

Since the left part of the mathematical expression 4 is 1.3158 and the right part is 1.3156 (is not related with $Z_1$), the mathematical expression 4 is satisfied and also (vii) is satisfied. For this reason, the second expression of the mathematical expression 1 is satisfied, the matching pole is not present and the ripple is not theoretically generated. As shown in FIG. 20A, the matching pole is not present, and the ripple is not generated in the passband.

(4) In the case where $Z_1$=70Ω

Since the left part of the mathematical expression 4 is 1.4 and the right part is 1.3156 (is not related with $Z_1$), the mathematical expression 4 is satisfied and also (vii) is satisfied. As a result, the second expression of the mathematical expression 1 is satisfied, the matching pole is not present and the ripple is not theoretically generated.

Figure 20B:
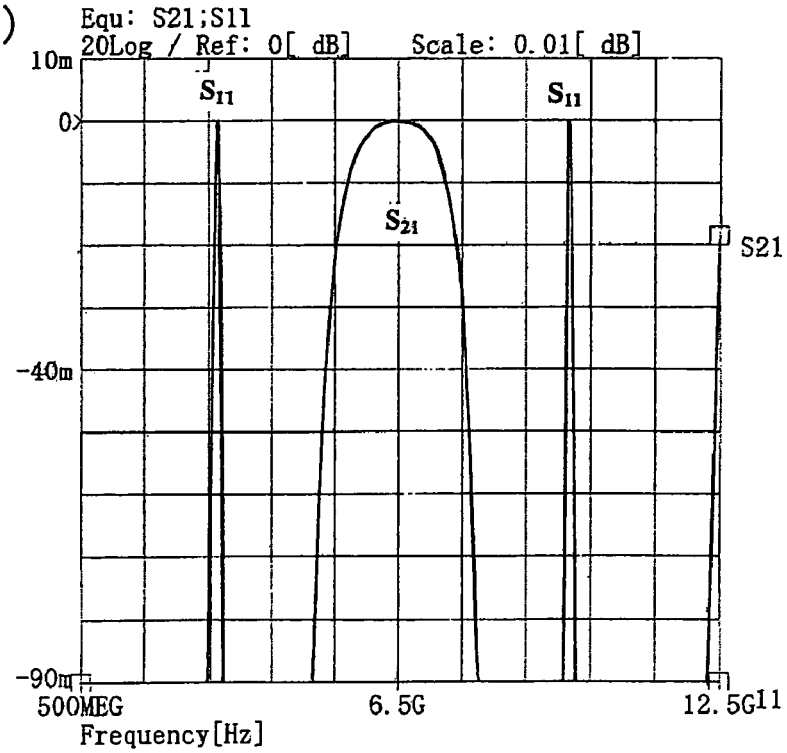
FIG. 20B is a simulation chart illustrating the ripple characteristics in the vicinity of the passband when $Z_0$=50Ω, $Z_1$=70Ω, $Z_2$=90Ω and $Z_3$=22.14Ω in the ring filter in FIG. 1.

As shown in FIG. 20B, the matching pole is not present, and the ripple is not generated in the passband.

According to the above simulation results, the appropriateness of the conditional expression (mathematical expression 1) that prevents the ripple from being generated in the passband was proved.

Figure 15:
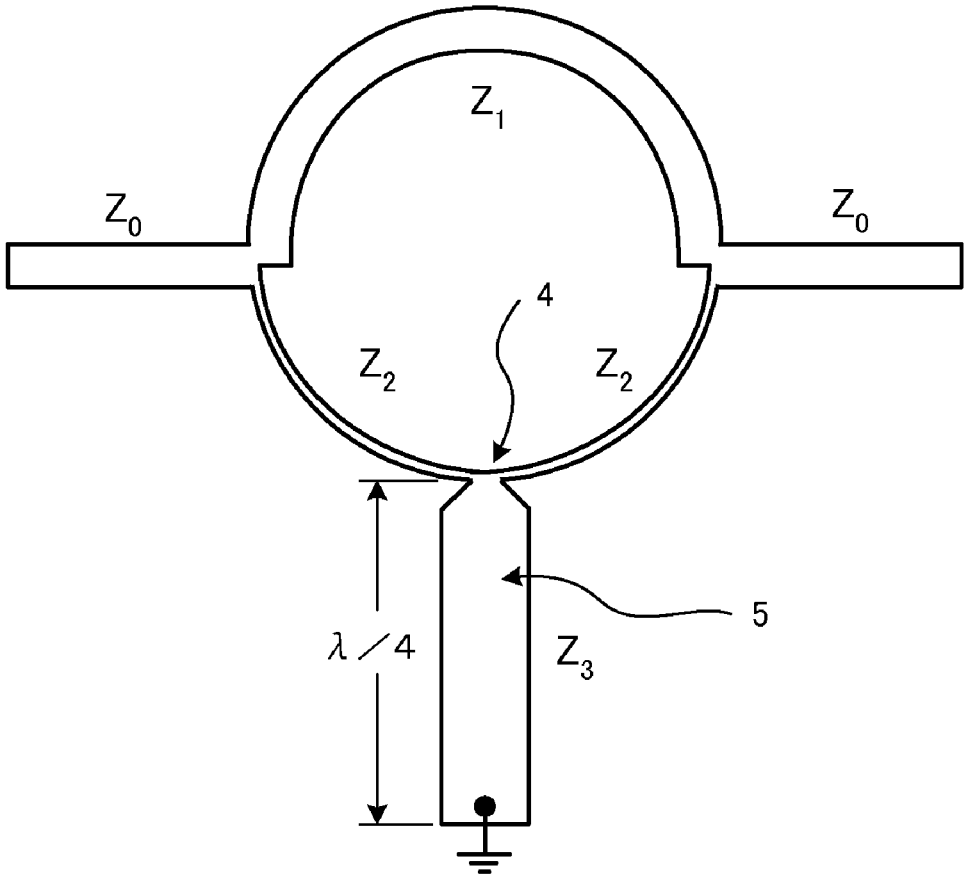
FIG. 15 is a diagram illustrating the ring filter that removes the DC component and a frequency component which is two times as high as a pass center frequency according to the embodiment of the present invention.

FIG. 15 illustrates the ring filter that rejects a DC component and a frequency component which is two times as high as the pass center frequency according to the embodiment of the present invention, and the ¼ wavelength (λ/4) short stub 5 is connected to the midpoint 4 of the lower ring portion.

Figure 13:
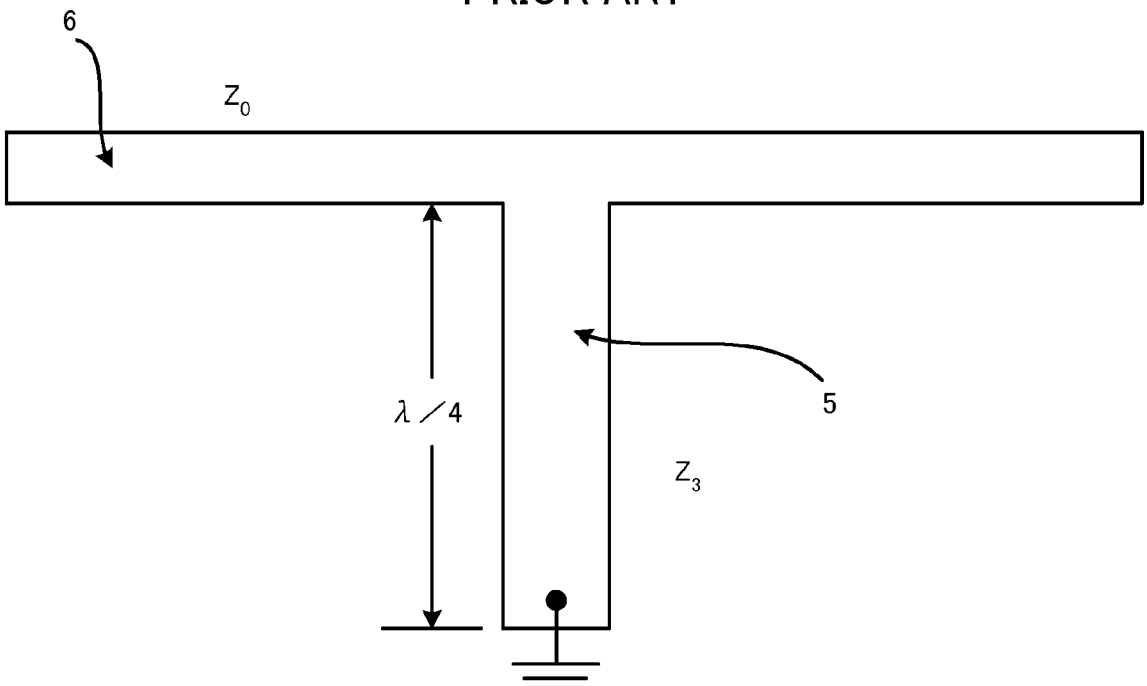
FIG.13 PRIOR ART
FIG. 13 is a pattern diagram illustrating a conventional example of a filter that removes a DC component.

Meanwhile, FIG. 13 is an example of a conventional filter that rejects the DC component and the frequency component which is two times as high as the pass center frequency, and the ¼ wavelength (λ/4) short stub 5 is provided to the transmission line 6 of 50Ω ($Z_0$).

Figure 14A:
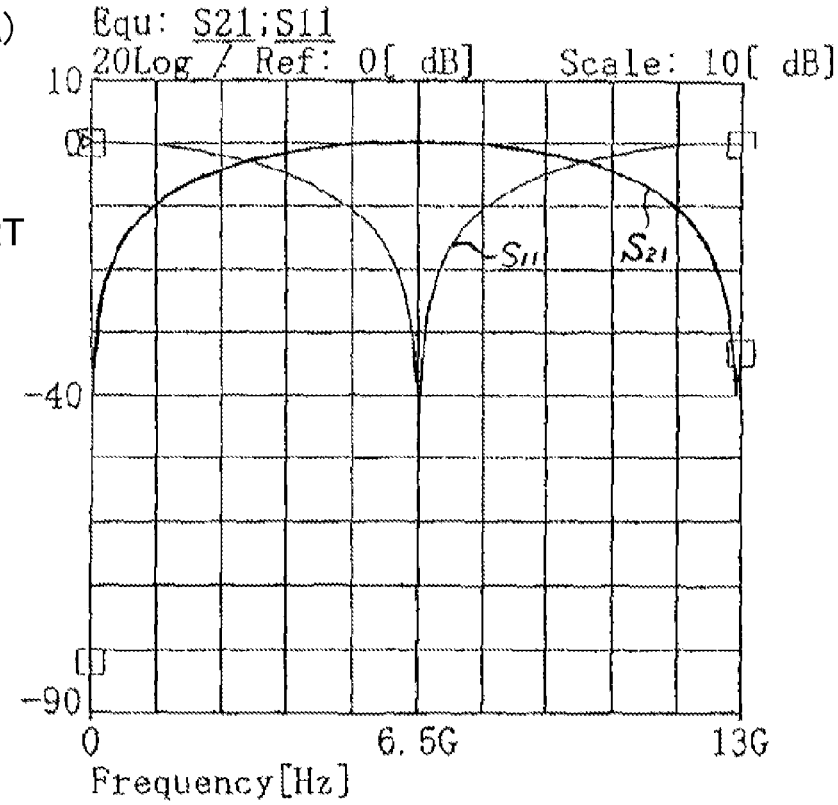
FIG.14(A) PRIOR ART
FIG. 14A is a simulation chart.
Figure 14B:
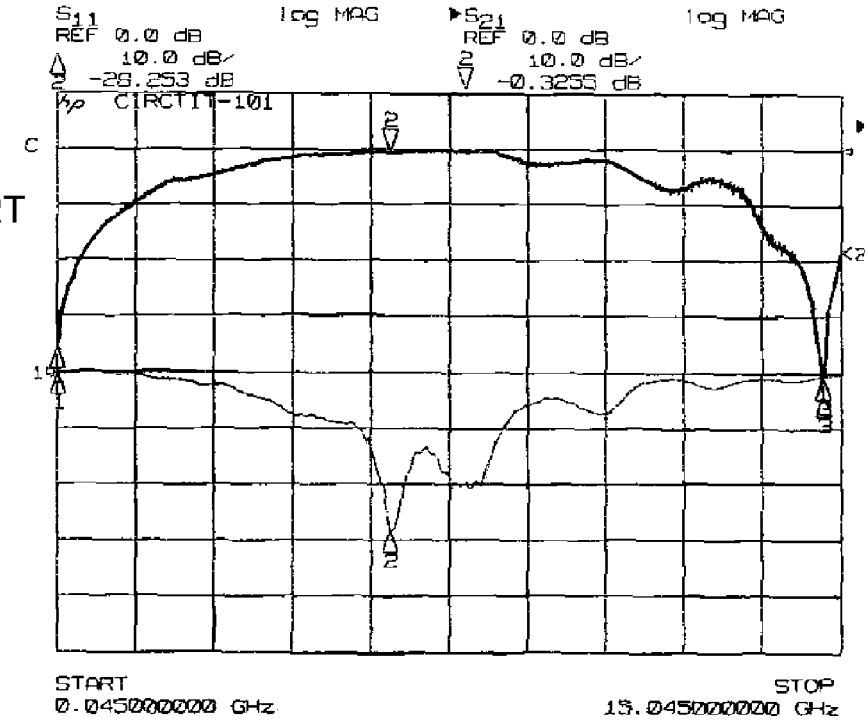
FIG.14(B) PRIOR ART
FIG. 14B shows actual measurement data.
Figure 16A:
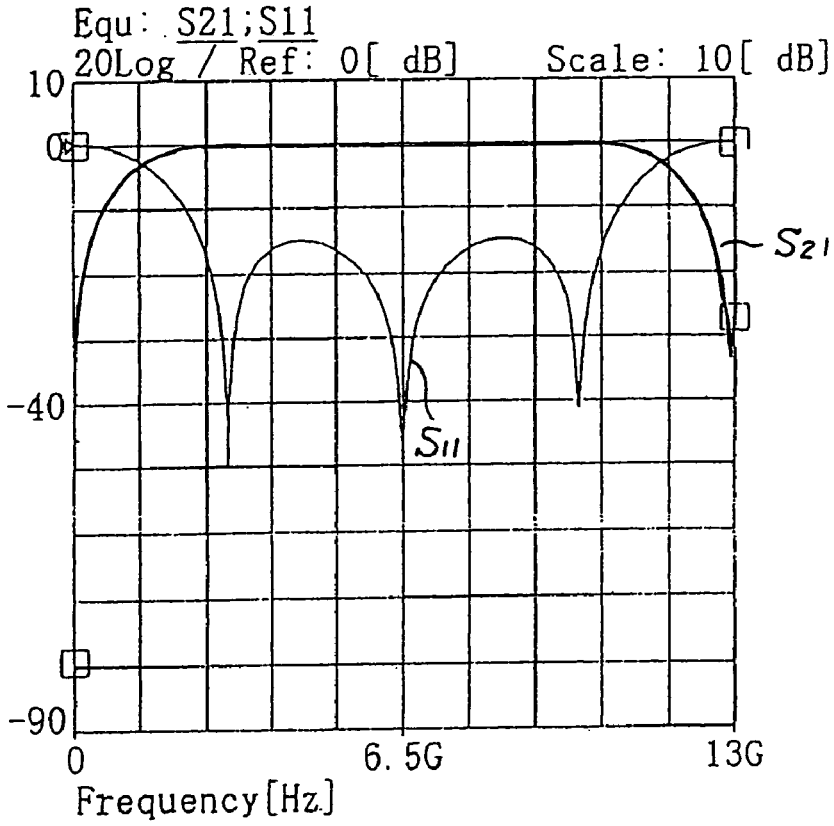
FIGS. 16A and 16B are diagram illustrating high-frequency characteristics (pass characteristics, reflecting characteristics) of the ring filter according to the embodiment shown in FIG. 15.
Figure 16B:
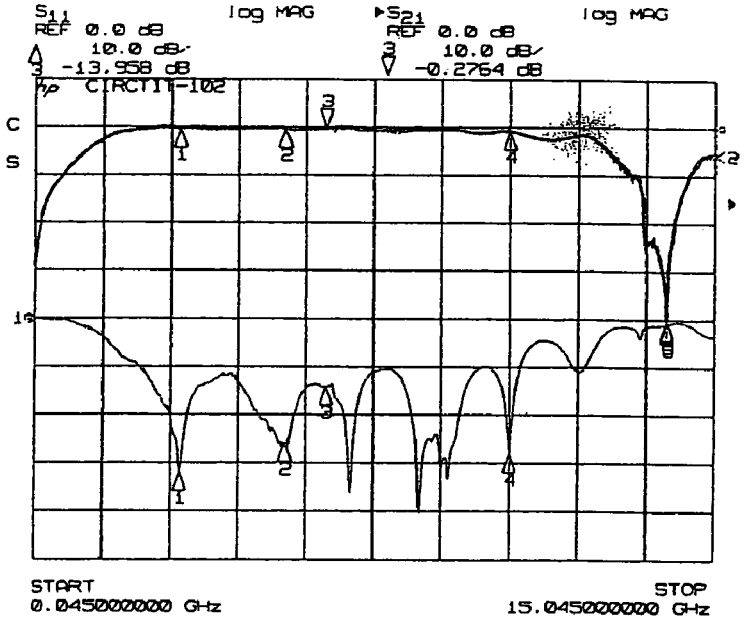

FIGS. 14 and 16 show pass characteristics of the ring filters having the ¼ wavelength short stub according to the conventional example and the present invention, respectively. In both the drawings, each of FIGS. 14A & 16A shows the simulation result, and each of FIGS. 14B & 16B shows actual measurement data, and both of them are approximate.

FIG. 14 shows pass characteristics ($S_{21}$) and reflecting characteristics ($S_{11}$) when $Z_0$=50Ω and $Z_3$=26.17Ω in FIG. 13, and this filter can reject the DC component and the frequency component which is two times as high as the pass center frequency, but its flatness is not good. Further, the reflection (loss) is small only at the pass center frequency but large at other frequencies.

Meanwhile, FIG. 16 shows pass characteristics ($S_{21}$) and reflecting characteristics ($S_{11}$) when $Z_0$=50Ω, $Z_1$=54.3Ω, $Z_2$=90Ω and $Z_3$=26.17Ω in FIG. 15, the DC component and the frequency component which is two times as high as the pass center frequency can be rejected, and flatness is maintained at the entire passband. Further, the reflection (loss) is small in the entire passband.

Figure 17:
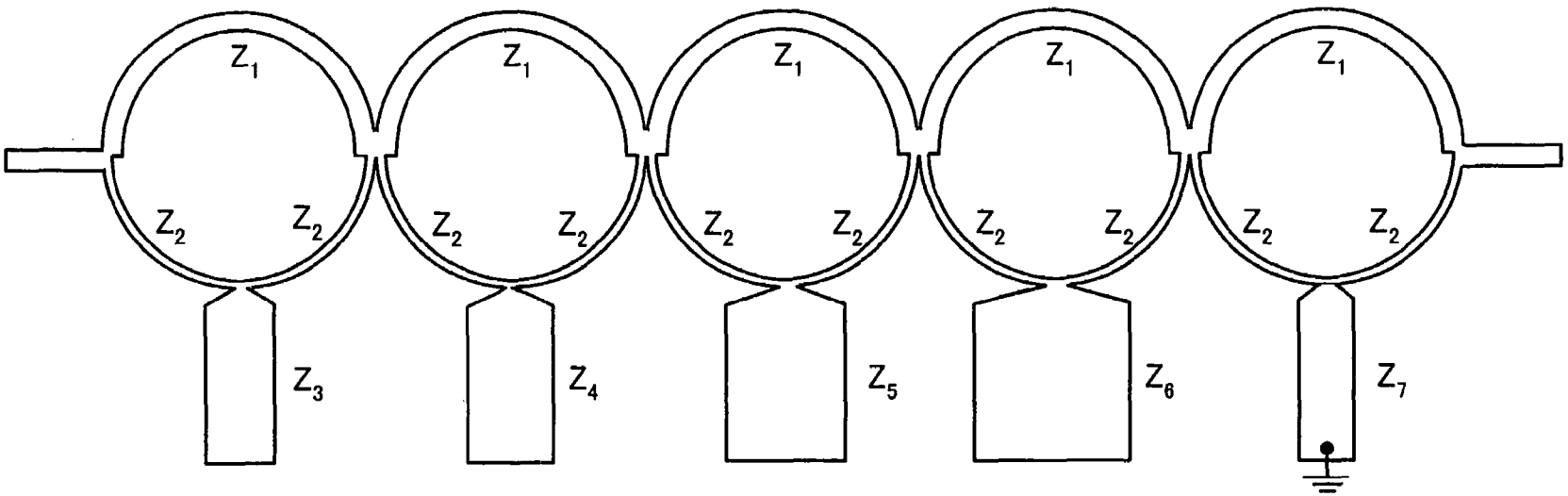
FIG. 17 illustrates a wideband band pass filter according to the embodiment in which four ring filters with the open stub in FIG. 1 are connected with one ring filter with short stub in FIG. 15 by cascade connection.
Figure 21A:
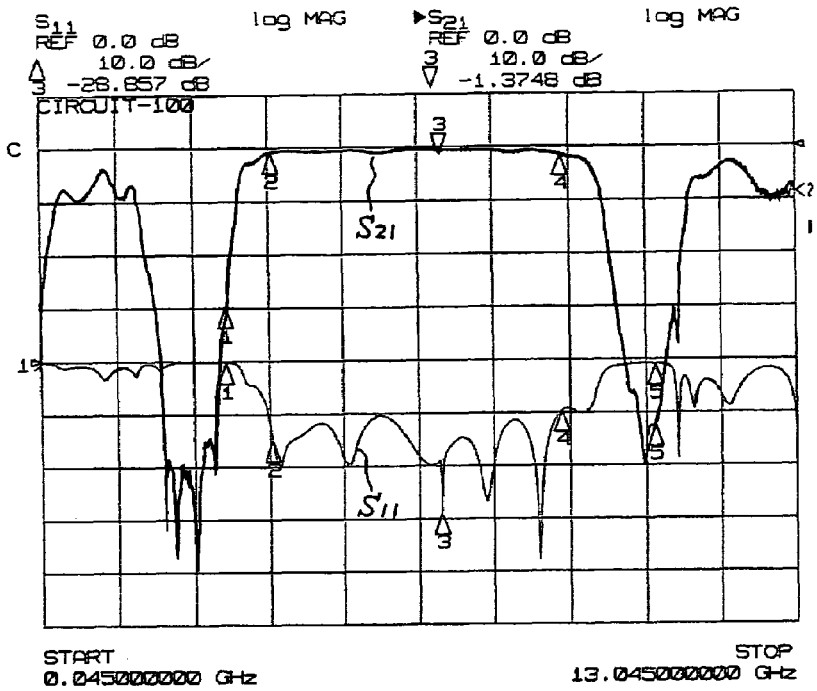
FIG. 21A is a diagram illustrating the high-frequency characteristics (pass characteristics, reflecting characteristics) of the band pass filter shown in FIG. 17 according to the embodiment.

FIG. 17 illustrates a wideband band pass filter constituted so that four ring filters with open stub in FIG. 1 and one ring filter with short stub in FIG. 15 are connected by cascade connection according to the embodiment. Since the attenuation pole frequencies are different, the cut-off frequency region can be entirely widened by the cascade connection, and the DC component and the frequency component which is two times as high as the pass center frequency can be rejected by the function of the ring filter with short stub at the right end. In FIG. 17, the characteristics of the band pass filter in the case where $Z_1$=54.3Ω, $Z_2$=90Ω, $Z_3$=21.6Ω, $Z_4$=15.6Ω, $Z_5$=11.7Ω, $Z_6$=9.1Ω and $Z_7$=24.49Ω are as shown in FIG. 21A ($S_{21}$ is the pass characteristics and $S_{11}$ is reflecting characteristics).

Figure 21B:
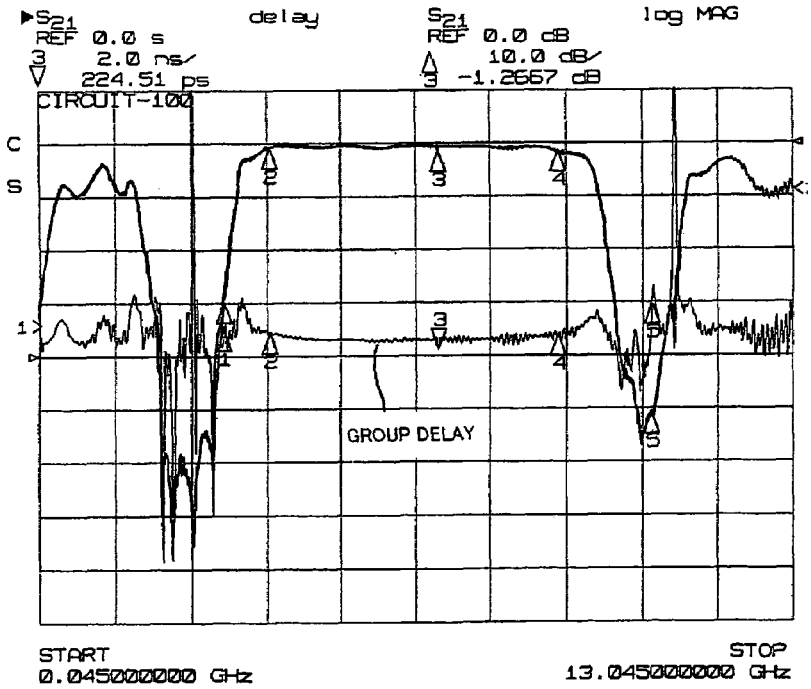
FIG. 21B is a diagram illustrating the high-frequency characteristics (pass characteristics, group delay characteristics) of the band pass filter shown in FIG. 17 according to the embodiment.

It is found that almost flat output characteristics can be obtained between about 4 GHz and about 9 GHz and the loss is small in that band. Further, great attenuation is seen on the DC side (frequency: 0 Hz), and it is found that the DC component is cut. As shown in FIG. 21B, the group delay characteristics are approximately constant in a wide range including the pass center frequency (6.5 GHz±2.5 GHz).

In this embodiment, the wideband band pass filter is constituted by combining the four ring filters with open stub and the one ring filter with short stub, but at least one ring filter with short stub can reject the DC component. Further, a number of stages of the ring filters with open stub to be connected may be increased in order to widen the band of the stop frequency.

INDUSTRIAL APPLICABILITY

As mentioned above, according to the ring filter and the band pass filter which is constituted by using it of the present invention, the pass characteristics such that the passband is flat and wide can be obtained, and steep attenuation is obtained in the stop band. Further, the DC component can be cut according to some combination of the ring filters, and a degree of design freedom is extremely high.

The band pass filter of the present invention is, therefore, incorporated into a high-frequency communication device which will be developed in the future, thereby enabling ultra-wideband communication which is ever impossible.

The invention claimed is:

1. A ring filter, characterized in that an input terminal (2) of a high-frequency signal is directly connected to an arbitrary point on a line in a microstripline ring resonator having the line with an electrical length of one wavelength, an output terminal (3) is directly connected to a point which is positioned at a half wavelength at electrical length from the input terminal (2), one end of a stub (5) of half wavelength at electrical length is directly connected to a point (4) positioned at ¼ wavelength at electrical length from the input terminal (2), and the other end of the stub (5) is grounded.

2. The ring filter according to claim 1, characterized in that both an input impedance and an output impedance of the ring resonator are designated by $Z_0$, an impedance of the half-wavelength line from the input terminal (2) to the output terminal (3) in the ring resonator is designated by $Z_1$, and an impedance of a ¼ wavelength line from the input terminal (2) to the connecting point (4) to the stub is designated by $Z_2$, wherein $Z_0$, $Z_1$ and $Z_2$ satisfy the following inequality:

$$Z_2/Z_0 \leqq 1$$

$$\left\{1+\sqrt{(1+4(Z_2/Z_0)^2)}\right\}\Big/(2Z_2/Z_0) < (Z_1/Z_0)$$

$$Z_2/Z_0 > 1$$

$$\left\{1+\sqrt{(1+4(Z_2/Z_0)^2)}\right\}\Big/(2Z_2/Z_0) < (Z_1/Z_0) < (Z_2/Z_0)/(Z_2/Z_0-1).$$

3. The ring filter according to claim 1, wherein a shape of the ring resonator is any one of circular, elliptic and quadrate shapes.

4. A ring filter, characterized in that an input terminal (2) of a high-frequency signal is directly connected to an arbitrary point on a line in a microstripline ring resonator having the line with an electrical length of one wavelength, an output terminal (3) is directly connected to a point which is positioned at a half wavelength at electrical length from the input terminal (2), one end of a stub (5) of ¼ wavelength at electrical length is directly connected to a point (4) positioned at ¼ wavelength at electrical length from the input terminal (2), and the other end of the stub (5) is grounded.

5. The ring filter according to claim 4, wherein a shape of the ring resonator is any one of circular, elliptic and quadrate shapes.

6. A ring filter, characterized in that an input terminal (2) of a high-frequency signal is directly connected to an arbitrary point on a line in a microstripline ring resonator having the line with an electrical length of one wavelength, an output terminal (3) is directly connected to a point which is positioned at a half wavelength at electrical length from the input terminal (2), a open stub (5) of ¼ wavelength at electrical length is directly connected to a point (4) positioned at ¼ wavelength at electrical length from the input terminal (2).

7. The ring filter according to claim 6, characterized in that both an input impedance and an output impedance of the ring resonator are designated by $Z_0$, impedance of the half-wavelength line from the input terminal (2) to the output terminal (3) in the ring resonator is designated by $Z_1$, and impedance of a ¼ wavelength line from the input terminal (2) to the connecting point (4) to the stub is designated by $Z_2$, wherein $Z_0$, $Z_1$ and $Z_2$ satisfy the following inequality:

$$Z_2/Z_0 \leqq 1$$

$$\left\{1+\sqrt{(1+4(Z_2/Z_0)^2)}\right\}\Big/2Z_2/Z_0 < (Z_1/Z_0)$$

$$Z_2/Z_0 > 1$$

$$\left\{1+\sqrt{(1+4(Z_2/Z_0)^2)}\right\}\Big/(2Z_2/Z_0) < (Z_1/Z_0) < (Z_2/Z_0)/(Z_2/Z_0-1).$$

8. The ring filter according to claim 7, wherein a shape of the ring resonator is any one of circular, elliptic and quadrate shapes.

9. The ring filter according to claim 6, wherein a shape of the ring resonator is any one of circular, elliptic and quadrate shapes.

* * * * *